US007665157B2

(12) United States Patent
Deutsch

(10) Patent No.: US 7,665,157 B2
(45) Date of Patent: Feb. 23, 2010

(54) CHILD'S TOILET TRAINING CHAIR

(76) Inventor: Diana Dorfman Deutsch, 83 Remsen St., Brooklyn, NY (US) 11201

( * ) Notice: Subject to any disclaimer, the term of this patent is extended or adjusted under 35 U.S.C. 154(b) by 837 days.

(21) Appl. No.: 11/389,364

(22) Filed: Mar. 23, 2006

(65) Prior Publication Data

US 2007/0220665 A1 Sep. 27, 2007

(51) Int. Cl.
*A47K 11/04* (2006.01)

(52) U.S. Cl. ..... 4/483; 4/905; 4/902; 297/338

(58) Field of Classification Search ..... 4/483, 4/905, 902, 239; 297/338
See application file for complete search history.

(56) References Cited

U.S. PATENT DOCUMENTS 2,547,408 A 4/1951 Owen
2,550,811 A * 5/1951 Ignatius ..... 297/338
3,258,291 A 6/1966 Ezquerra
3,364,478 A 1/1968 Waard
4,798,412 A * 1/1989 Kohus et al. ..... 297/338
4,854,638 A * 8/1989 Marcus et al. ..... 297/256.11
5,787,518 A 8/1998 Mendelovich et al.
6,634,712 B2 * 10/2003 Gamble ..... 297/338

OTHER PUBLICATIONS

PCT/US 07/03828, Written Opinion of the International Searching Authority, mailed Nov. 1, 2007.
PCT/US 07/03828, International Preliminary Report on Patentability, mailed Jul. 28, 2008.

* cited by examiner

*Primary Examiner*—Khoa D Huynh
(74) *Attorney, Agent, or Firm*—Abelman, Frayne & Schwab

(57) ABSTRACT

A child's toilet training chair includes a seat supporting structure and an adjustable seat that can be positioned at an acute angle relative to the horizontal. The front section of the seat is pivotally attached to a front portion of the supporting structure and the rear portion of the seat is provided with at least one engagement member that releasably mates with one of a plurality of vertically-spaced receiving elements in the chair back.

13 Claims, 6 Drawing Sheets

CHILD'S TOILET TRAINING CHAIR

FIELD OF THE INVENTION

The invention relates to the construction and use of a child's toilet training chair, commonly referred to as a potty chair.

BACKGROUND OF THE INVENTION

Small children are typically introduced to toilet training by encouraging them to sit on an appropriately scaled, but otherwise conventional appearing chair having a back, armrests, a seating area with an opening and, optionally a folding seat cover, the latter corresponding to a conventional toilet seat cover. The underside of the chair is fitted with means for retaining a waste-receiving receptacle having a handle or other structure to facilitate its removal after use, carrying and emptying of the waste from the receptacle into the toilet.

In these toilet training chairs, or potty chairs, of the prior art, the seat typically forms part of the unitary structure of the chair and is positioned parallel to the floor or other surface upon which the training chair is positioned.

In an apparent effort to encourage the child's early acceptance and use of the toilet, a wide variety of structures have been proposed for toilet training. These include molded plastic structures in the form of various animals, including a bear, and vehicles, including tugboats, automobiles and trucks. All of these devices for the potty training of toddlers are provided with a substantially horizontal seating position with an opening below which is positioned a waste receiving receptacle. In some cases, the child straddles the structure and in others assumes a normal seated position.

Toilet training is usually initiated after a toddler has progressed to the point of being able to walk around with a reasonable level of competence. It has been noted that toddlers wearing diapers will typically and commonly assume a squatting position for the purpose of initiating a bowel movement. The squatting position is also assumed by adults living in aboriginal or other primitive communities which have neither the benefit of indoor toilets, or outdoor latrines or other facilities for the sanitary disposal of their excrement.

It is therefore an object of the present invention to provide a potty training chair that is configured to encourage a toddler's early use by permitting the assumption of a more natural posture at the early stage of training.

A further object of the invention is to provide a toilet training chair for which the seating position can be adjusted during the course of the child's training.

SUMMARY OF THE INVENTION

The deficiencies of the prior art are overcome, and other advantages described herein are achieved by providing a child's toilet training chair having an adjustable seat that is rearwardly declined at an acute angle from the horizontal.

The chair includes a seat supporting structure and a seat with a central opening. The seat has a front section, a rear section, and a waste receiving receptacle. Preferably, the front section is pivotally attached to a front portion of the support structure. The rear section is provided with at least one engagement member, and the supporting structure of the chair preferably includes a back portion extending to a position proximate the base of the chair. The back has a plurality of vertically spaced receiving elements for securely receiving the at least one engagement member of the seat, of which the topmost receiving element is positioned to align the seat in a substantially horizontal position for use and the lowermost receiving element is positioned to engage the seat at a rearwardly declined acute angle for use. The waste receiving receptacle is removably secured in a position below the underside of the seat and surrounds the central opening in the seat. The placement of the engagement member in the lowermost receiving element in the back of the chair positions the seat for use by a child in a low-squatting posture.

BRIEF DESCRIPTION OF THE DRAWINGS

The construction and use of the present invention will be further described in the following detailed description that is to be read in conjunction with the accompanying drawings in which.

Figure 1:
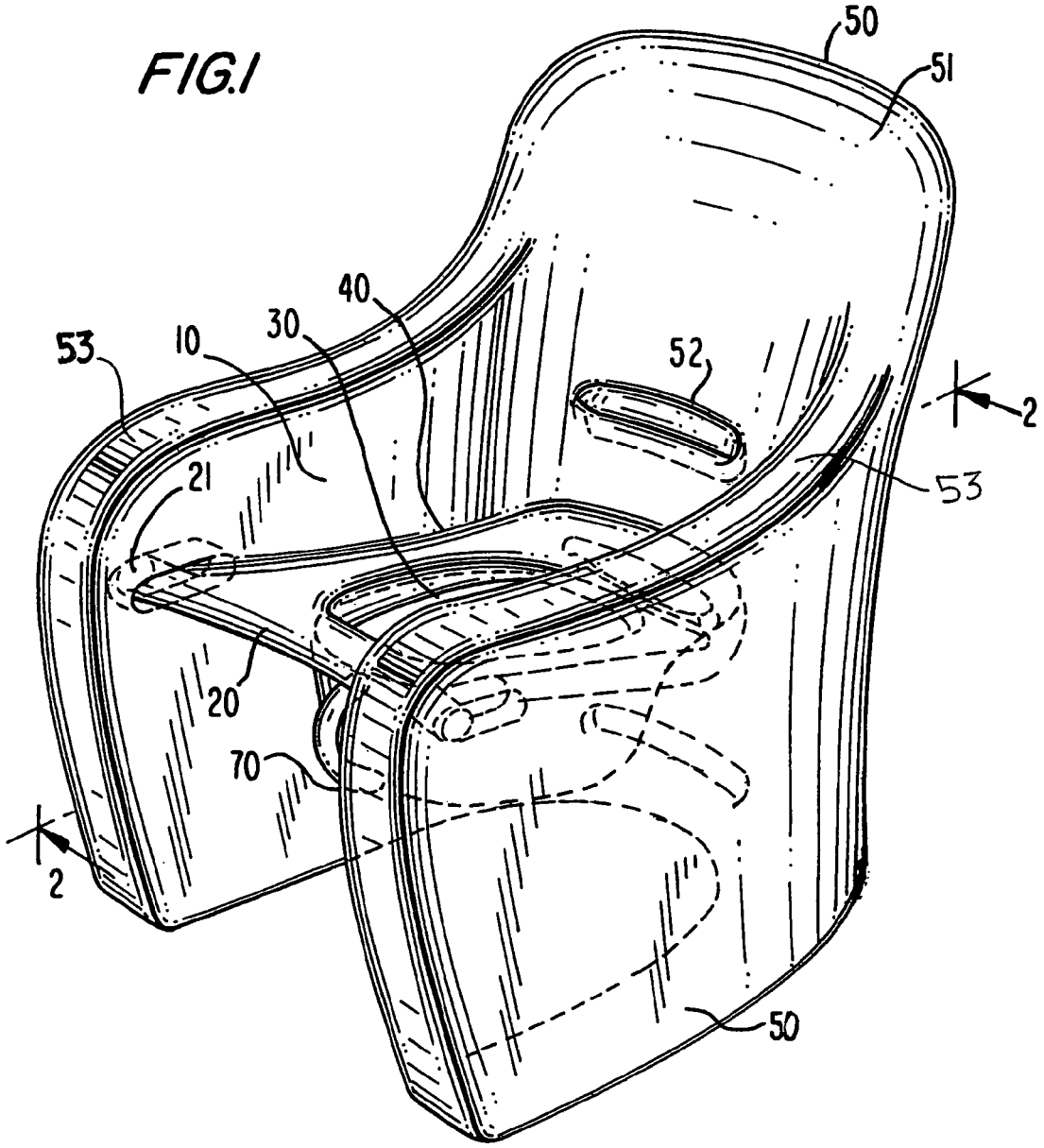
FIG. 1 is a front perspective view of a child's toilet training chair.

To facilitate an understanding of the invention, the same reference numerals have been used, when appropriate, to designate the same or similar elements that are common to the figures. Unless stated otherwise, the features shown and described in the figures are not drawn to scale, but are shown for illustrative purposes only.

DETAILED DESCRIPTION OF THE PREFERRED EMBODIMENT

Although the present invention will be described herein with reference to a child's toilet training chair, it should be understood that the apparatus of the present invention may be used by adults as an appropriately scaled toilet chair, e.g., for the aged or disabled who may benefit from the lowest squatting position.

Referring to FIGS. 1-4, a child's toilet training chair 1 includes a seat 10, a seat supporting structure 50, and a waste receiving receptacle 70. The seat 10 has a front section 20 and a rear section 40. The seat supporting structure 50 includes a back 51, receiving elements 52 and arms 53. The waste receiving receptacle 70 includes an upper rim 71, a disposable bag 72, and a handle 73. The chair 1 can be made of a molded rigid plastic material, wood, a combination of these materials or other materials known to the art. In a preferred embodiment, the seat 10 is a separate element that is removably attachable to the support 50. This construction will facilitate manufacture and any cleaning that may be necessary following use.

The front section 20 has a pair of opposing posts 21, which extend laterally from side edges of the front section 20 proximate front edges of the front section 20. The opposing posts 21 allow the front section 20 to be pivotally attached to a front portion of the supporting structure 50. The rear section 40 has a central opening 30 through which baby's bodily wastes pass. The central section of leading edge of the seat 10 has a convex curvilinear form. The seat 10 is removably secured to the supporting structure 50 by positioning the seat 10 in a generally vertical position and engaging first one opposing post 21 in one end of the opposing openings 54 and twisting the opposing post 21 to position it in the opposing elongated opening 54.

In a further preferred embodiment, (not shown), the arms of the chair move with the seat 10 and remain generally parallel with the plane of the seat during adjustment. As will be apparent to those of ordinary skill in the art, a wide variety of other structural configurations can be employed to achieve a functionally equivalent structure. For example, the back portion 51 can be higher or lower than shown in the attached illustrations and/or can be provided with fanciful design elements. The position and shape of the arms formed by side portions 10 can also be varied and, e.g., provided with hand holds to assist the user in rising from the squatting position shown in FIG. 3.

Figure 5:
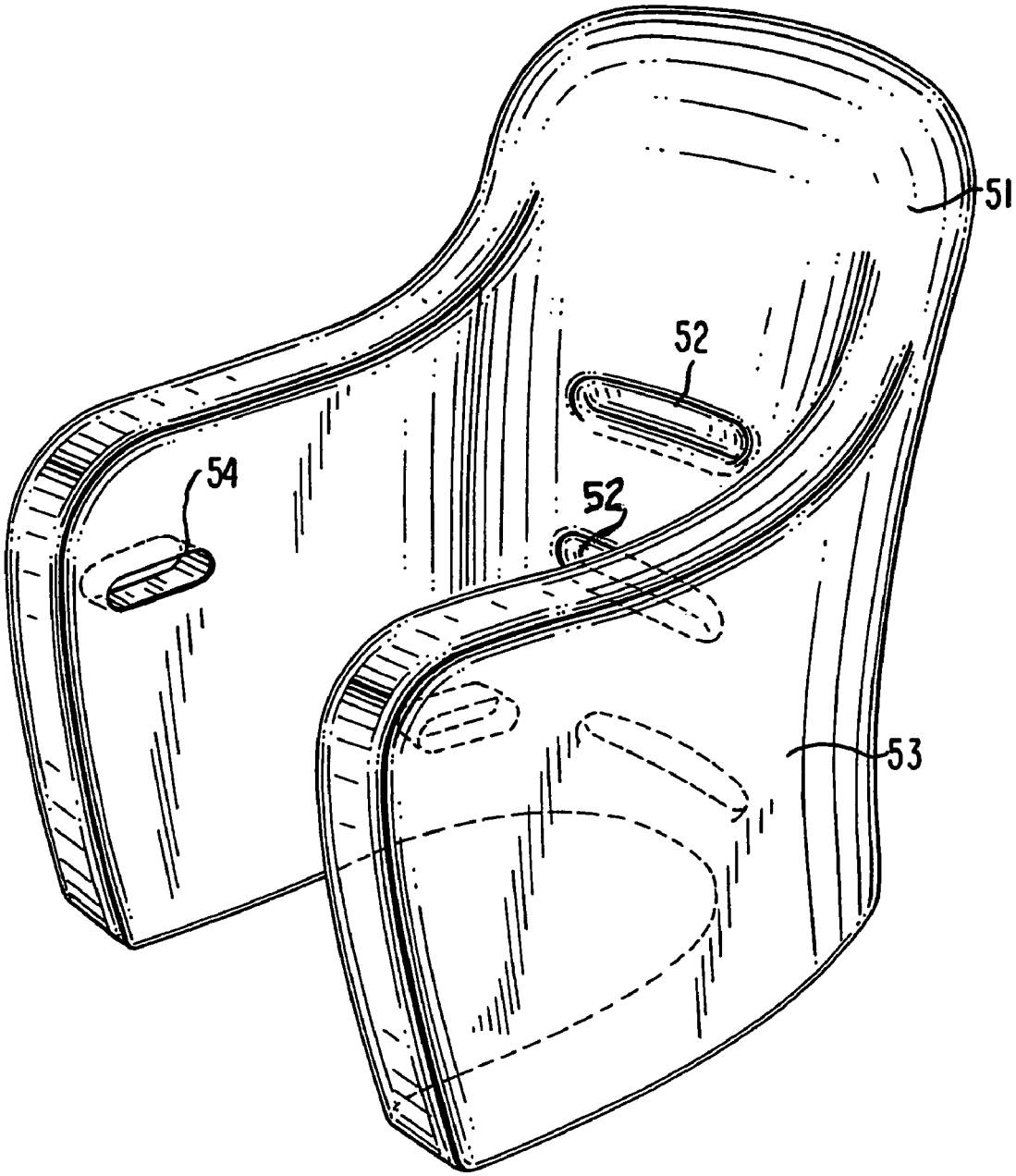
FIG. 5 is a front perspective view of a seat-supporting structure of the child's toilet training chair.

Referring to FIG. 5, the supporting structure 50 has a back 51 and arms 53, which, in combination, form a U-shaped plane figure. The supporting structure 50 is generally U-shaped having an exterior surface extending from the bas up to the arms and continuing up the back 51 to form a unitary structure. The arms 53, fixed with respect to the supporting structure 50, extend to the back 51. A change in the position of the seat 10, via a change of receiving elements 52 to which the seat 10 is secured, also changes the position of the arms 53 with respect to the supporting structure 50 of the chair 1.

The front of the seat 10 is about 6 inches above the supporting surface, and the back portion extends at least 12 inches above the base of the chair 1. The seat 10 forms an acute angle of X° to the horizontal when the seat 10 is engaged in the lowermost receiving element 52. The angle is determined with respect to the other elements of the chair's construction, and preferably is at most 45°.

Elongated openings 54 having an elliptical shape are formed in opposing vertically extending inner sidewalls of the arms 53 proximate front edges of the supporting structure 50. The elongated openings 54 receives the opposing posts 21 of the seat 20 slidingly, which renders the rear seat 40 moveable with respect to the back 51 of the chair 1.

Figure 2:
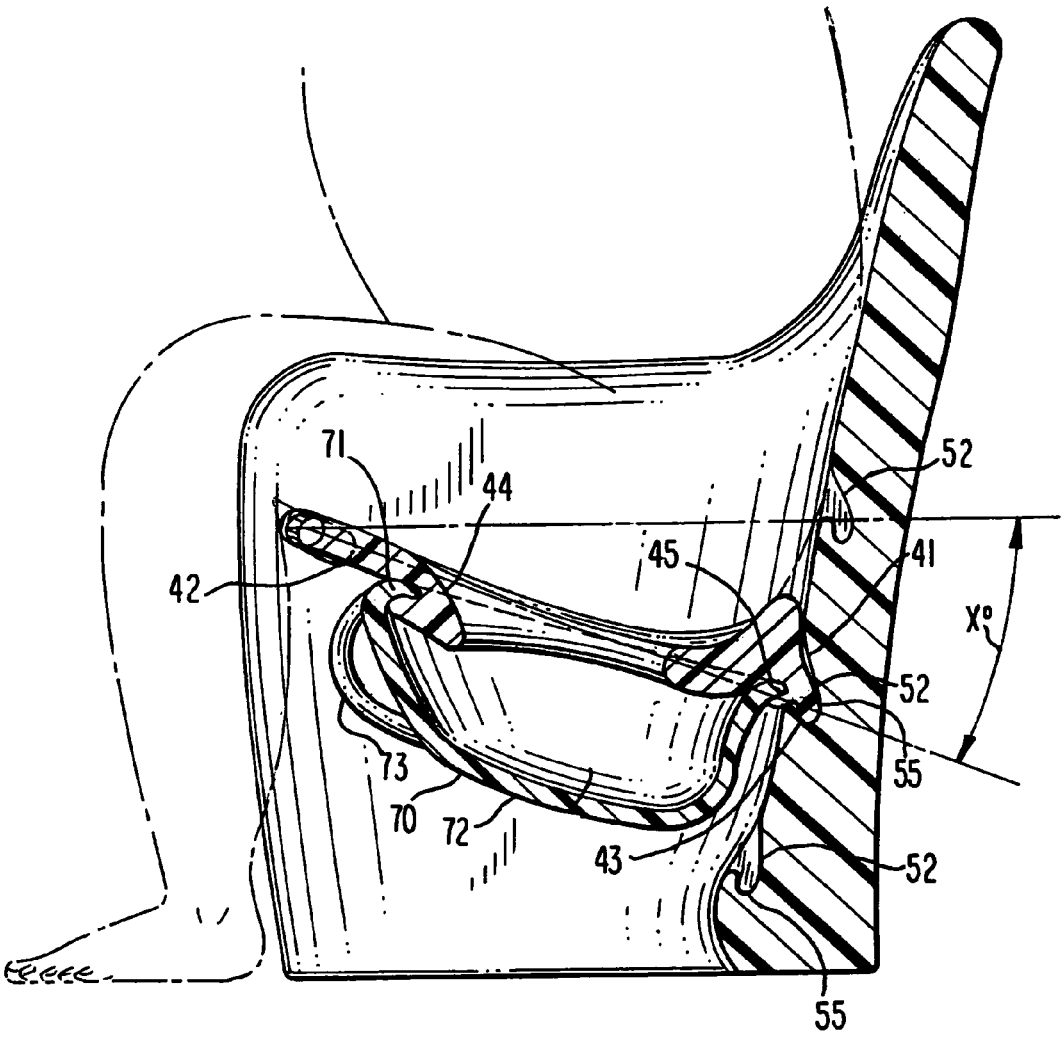
FIGS. 2-4 are cross sectional views of the child's toilet training chair taken along line 2-2 in FIG. 1.
Figure 3:
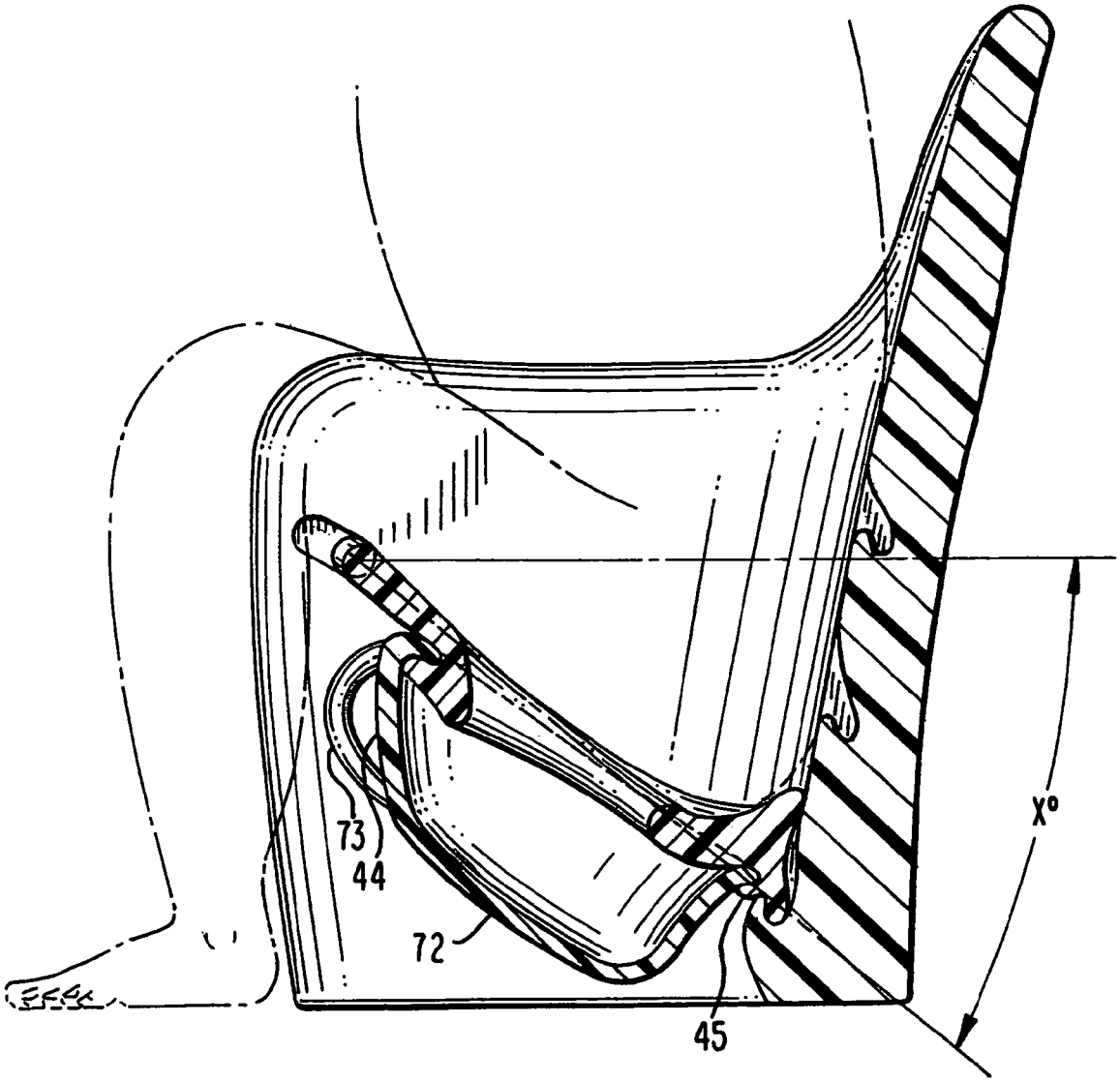
Figure 4:
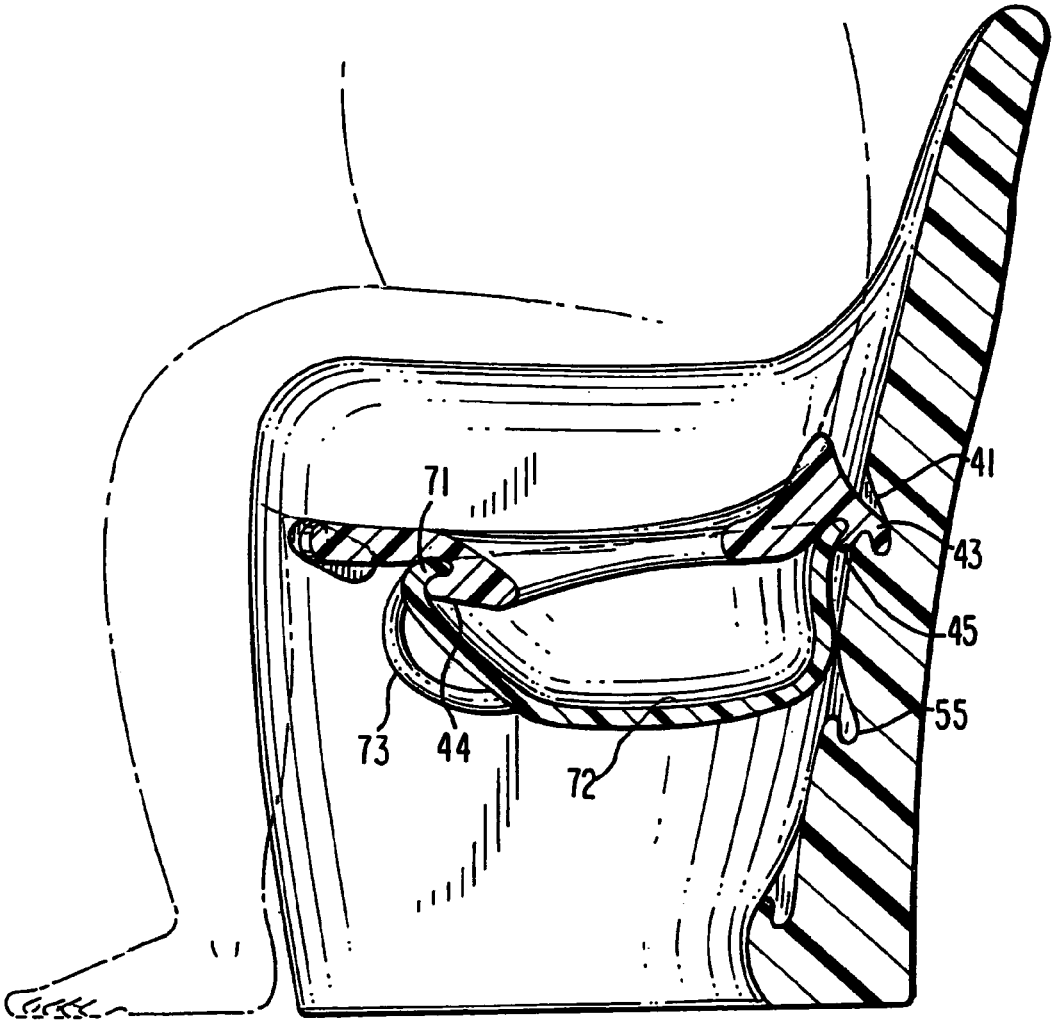

Referring to FIGS. 2-5, the lower portion of back 51 extends to a position proximate the base of the chair 1. The back 51 has a plurality of vertically-spaced receiving elements 52, which allows the seat 10 to be disposed at a variety of angles against the back. The receiving elements 52 securely receive the engagement member 41 of the seat 10. As shown in FIGS. 2-4, the topmost receiving element 52 is positioned to align the seat 10 in a substantially horizontal position and the lowermost receiving element 52 is positioned to engage the seat 10 at a rearwardly declined acute angle. These diverse angled positions of the seat 10 permits the baby to sit in diverse positions.

Referring to FIGS. 2-5, an engagement member 41 is positioned on the underside 42 of the rear section 40 proximate the supporting structure 50. The engagement member 41 includes a locking portion 43. The receiving element 52 also includes a locking portion 55. The locking portion 43 is configured to engage and secure releasably a locking portion 55 of a receiving element 52, when the seat 20 is positioned at the receiving element 55 of the receiving element 52.

The seat 10 also includes retaining member 44, 45, that are formed on the underside 42 of the seat 10 proximate the central opening 30 and are configured to releasably secure the waste receiving receptacle 70. As will be apparent to those of ordinary skill in the art, a wide variety of other means for engaging and securing the receptacle 70 can be used.

Figure 8:
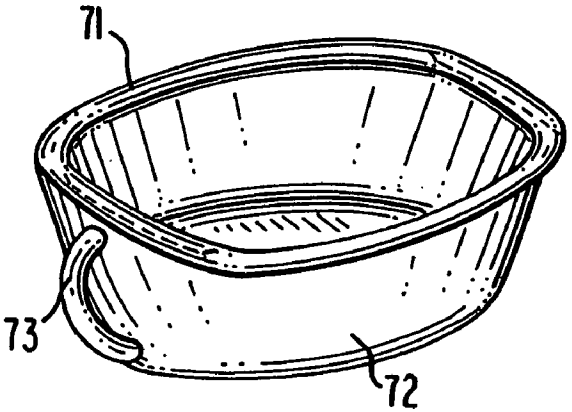
FIG. 8 is a top perspective view of a waste receiving receptacle of the child's toilet training chair.
Figure 9:
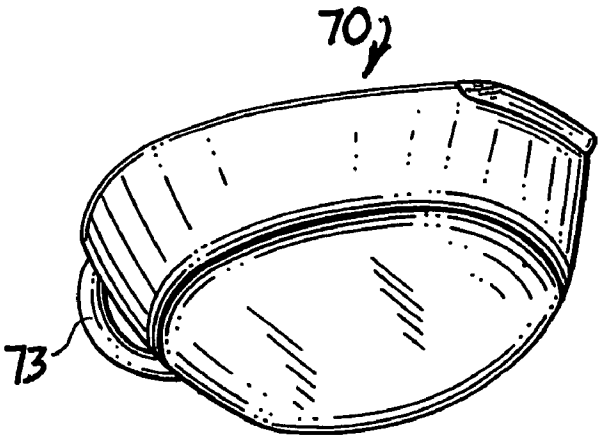
FIG. 9 is a bottom perspective view of the waste receiving receptacle of the child's toilet training chair.
Figure 6:
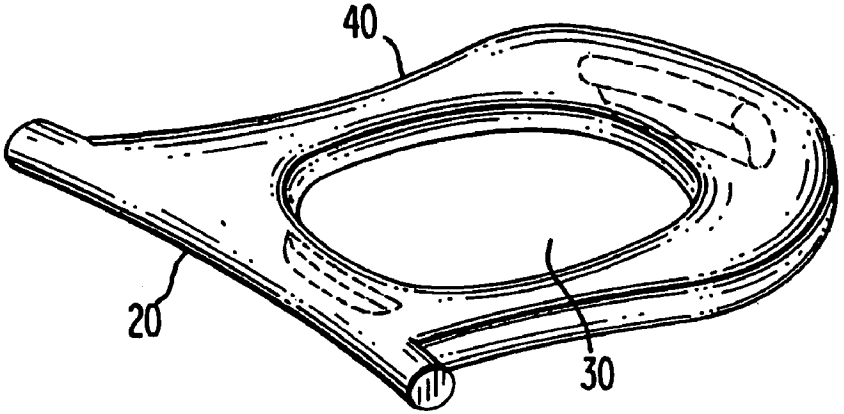
FIG. 6 is a top perspective view of a seat of the child's toilet training chair.
Figure 7:
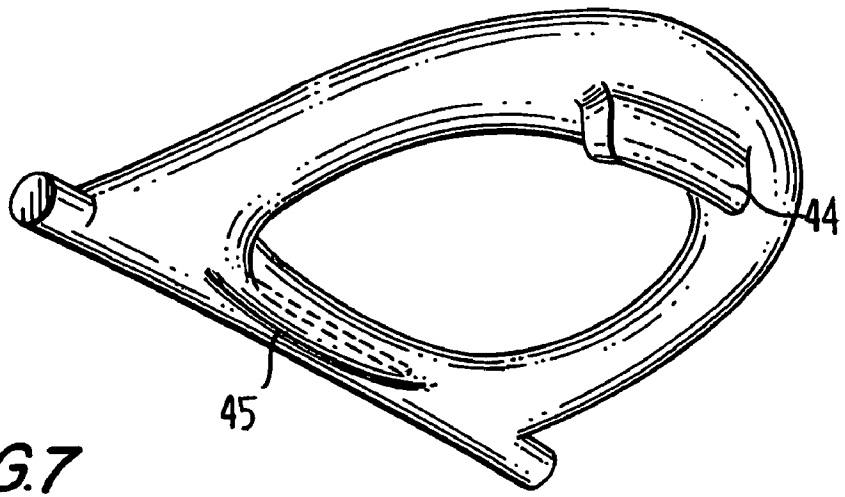
FIG. 7 is a bottom perspective view of the seat.

Referring to FIGS. 4, 7, 8, the waste receiving receptacle 70 is removably secured in a position below the underside 42 of the seat 10 and surrounds the central opening 30 to thereby receive and retain liquid and solid bodily wastes. The waste receiving receptacle 70 includes an upper rim 71 and a handle 73. The upper rim 71 has an elliptical shape conforming substantially to the central opening 30, but larger. The upper rim 71 is removably secured to retaining members 44, 45 that depend from the underside 42 of seat 10. The disposable plastic bag (not shown) can be positioned over the rim to receive baby's bodily waste. The handle 73 is provided to facilitate the removal of the waste containing receiving receptacle. In a preferred embodiment, the receptacle 70 is sufficiently flexible or pliable to permit the slight deformation required to engage rear retaining member 45 and them snap from rim 71 into a secured position with front retaining member 44. Receptacle 70 is preferred removed from the front of the chair 10.

Although a preferred embodiment that incorporates the teachings of the present invention has been shown and described in detail, those skilled in the art can readily devise many other varied embodiments that are within the scope of the invention as determined by the claims that follow.

I claim:

1. A child's toilet training chair for use on a flat supporting surface which includes a seat supporting structure and a seat with a central opening, the seat having:

a. a front section that is pivotally attached to a front portion of the supporting structure by opposing posts extending laterally from the side edges of the seat proximate its front edge, and b. a rear section that is provided with an engagement member that projects downwardly from the seating surface, the supporting structure of the chair including a back extending to a position proximate the base of the chair, the back having a plurality of vertically-spaced receiving elements for securely receiving the at least one engagement member of the seat, the topmost receiving element being positioned to align the seat in a substantially horizontal position for use and the lowermost receiving element positioned to engage the seat at a rearwardly declined acute angle for use, the supporting structure of the chair further including a pair of elongated openings formed in opposing vertically extending side walls, said pair of elongated openings dimensioned to receive the posts of the seat to thereby allow the seat to slide back and forth with respect to the back of the chair to thereby facilitate the movement of said seat to different receiving elements wherein the sliding movement of said posts is maintained within said elongated openings and without separation from said elongated openings, and a waste receiving receptacle that is removably secured in a position below the underside of the seat and surrounding the central opening in the seat, whereby the placement of the engagement member in the lowermost receiving element in the back of the chair positions the seat for use by a child in a low-squatting posture.

2. The chair of claim 1 in which the engagement member includes a locking portion and the receiving element includes a first receiving portion and a locking portion configured to engage and releasably secure the locking portion of the engagement member when the seat is positioned for use.

3. The chair of claim 1 in which the back has at least three receiving elements, the lowermost of which is proximate the base.

4. The chair of claim 1 which includes a front access opening for installation and retrieval of the waste receptacle.

5. The chair of claim 1 in which the waste receptacle is asymmetrically formed below an upper rim to thereby retain liquid and solid waste disposed therein when the receptacle is removed and when the seat is in other than a horizontal position.

6. The chair of claim 1 that is formed of a molded rigid plastic material.

7. The chair of claim 1 in which the central section of the leading edge of the seat has a convex curvilinear form.

8. The chair of claim 1 in which the supporting structure includes arms extending to the back.

9. The chair of claim 8 in which the arms are fixed with respect to the supporting structure.

10. The chair of claim 8 in which the arms are fixed with respect to the seat, whereby a change in the position of the seat also changes the position of the arms with respect to the supporting structure of the chair.

11. The chair of claim 1 in which the front of the seat is about six inches above the supporting surface, the back extends at least twelve inches above the base of the chair and the seat forms an angle of about 45° to the vertical when engaged in the lowermost receiving element position.

12. The chair of claim 6 in which the supporting structure is generally U-shaped having an exterior surface extending from the base up to the arms and continuing up the back to form a unitary structure.

13. The chair of claim 1 in which the seat is removably secured to the supporting structure by positioning the seat in a generally vertical position and engaging first one post in one of the opposing openings and twisting the opposing post to position it in the opposing elongated opening.

* * * * *

UNITED STATES PATENT AND TRADEMARK OFFICE

CERTIFICATE OF CORRECTION

PATENT NO. : 7,665,157 B2
APPLICATION NO. : 11/389364
DATED : February 23, 2010
INVENTOR(S) : Diana Dorfman Deutsch It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 964 days.

Signed and Sealed this

Twenty-eighth Day of December, 2010

David J. Kappos

David J. Kappos
*Director of the United States Patent and Trademark Office*